US006513520B2

(12) United States Patent
Vinokur et al.

(10) Patent No.: US 6,513,520 B2
(45) Date of Patent: Feb. 4, 2003

(54) SNORKEL SYSTEM

(76) Inventors: Anthony Vinokur, 1423-24th Ave., San Francisco, CA (US) 94122; Galina Levinson, 1423-24th Ave., San Francisco, CA (US) 94122

( * ) Notice: Subject to any disclaimer, the term of this patent is extended or adjusted under 35 U.S.C. 154(b) by 0 days.

(21) Appl. No.: 09/858,565

(22) Filed: May 15, 2001

(65) Prior Publication Data

US 2002/0170558 A1 Nov. 21, 2002

(51) Int. Cl.[7] ..... B63C 11/16
(52) U.S. Cl. ..... 128/201.11; 128/201.27
(58) Field of Search ..... 128/201.11, 201.27, 128/201.28, 202.27

(56) References Cited

U.S. PATENT DOCUMENTS

| | | | | | |
|---|---|---|---|---|---|
| 908,690 | A | * | 1/1909 | Neubert | 128/201.11 |
| 2,317,237 | A | | 4/1943 | Wilen | |
| 2,753,865 | A | * | 7/1956 | Van Der Kogel | 128/201.11 |
| 3,721,236 | A | | 3/1973 | Bardehle | |
| 3,908,647 | A | * | 9/1975 | Taunton | 128/201.11 |
| 4,071,024 | A | | 1/1978 | Blanc | |
| 4,583,536 | A | * | 4/1986 | Jan | 128/201.11 |
| 4,879,995 | A | * | 11/1989 | Christianson | 128/201.11 |
| 5,092,324 | A | * | 3/1992 | Christianson | 128/201.11 |
| 5,117,817 | A | * | 6/1992 | Lin | 128/201.11 |
| 5,199,422 | A | * | 4/1993 | Rasocha | 128/201.11 |
| 5,239,990 | A | | 8/1993 | Delphia | |
| 5,265,591 | A | * | 11/1993 | Ferguson | 128/201.11 |
| 5,267,556 | A | | 12/1993 | Feng | |
| 5,280,785 | A | | 1/1994 | Fujima | |
| 5,404,872 | A | * | 4/1995 | Choi | 128/201.11 |
| 5,535,734 | A | * | 7/1996 | Lu et al. | 128/201.27 |
| 5,606,967 | A | * | 3/1997 | Wang | 128/201.11 |
| 5,865,169 | A | * | 2/1999 | Lan et al. | 128/201.11 |
| 5,893,362 | A | * | 4/1999 | Evans | 128/201.11 |
| 6,073,626 | A | * | 6/2000 | Riffe | 128/201.11 |
| 6,129,081 | A | | 10/2000 | Wu | |
| 6,371,108 | B1 | * | 4/2002 | Christianson | 128/201.11 |

* cited by examiner

*Primary Examiner*—Aaron J. Lewis
*Assistant Examiner*—Joseph F. Weiss, Jr.
(74) *Attorney, Agent, or Firm*—Michael S. Neustel

(57) ABSTRACT

A snorkel system for allowing an individual snorkeling to dive beneath the water surface without water entering the breather tube. The snorkel system includes a breathing tube having an upper opening, a mouthpiece attached to a lower end of the breathing tube, a housing attached about an upper portion of the breathing tube, and a plurality of apertures within a lower portion of the housing. The upper opening of the breathing tube is positioned a finite distance above the highest of the apertures for creating a pressurized air pocket within the housing that prevents water level from rising above the upper opening thereby preventing water from entering the upper opening when the housing is fully submerged. The plurality of apertures within the lower portion allow the water to escape when the housing is elevated above the water surface and allow for air to immediately enter the housing and therefore the breathing tube thereby allowing the individual to freely breathe.

11 Claims, 9 Drawing Sheets

SNORKEL SYSTEM

BACKGROUND OF THE INVENTION

1. Field of the Invention

The present invention relates generally to snorkels and more specifically it relates to a snorkel system for allowing an individual snorkeling to dive beneath the water surface without water entering the breather tube.

2. Description of the Prior Art

Snorkels have been in use for years. Typically, a snorkel is comprised of a mouthpiece that the user inserts into their mouth with a breather tube that is elongate and curved to be positioned upwardly above the head of the user thereby allowing the individual to position their face within the water while still being able to breath freely via the breather tube.

The main problem with conventional snorkel devices is that they accumulate water within the breather tube if the user decides to dive beneath the water surface. Another problem with conventional snorkel devices is that they require the user to purge the water within the breather tube after diving prior to being able to breath utilizing the breather tube.

Examples of patented snorkel related devices which are illustrative of such prior art include U.S. Pat. No. 4,071,024 to Blanc; U.S. Pat. No. 5,267,556 to Feng; U.S. Pat. No. 2,317,237 to Wilen; U.S. Pat. No. 5,239,990 to Delphia; U.S. Pat. No. 3,721,236 to Bardehle; U.S. Pat. No. 5,280, 785 to Fujima; U.S. Pat. No. 6,073,626 to Riffe; U.S. Pat. No. 6,129,081 to Wu.

While these devices may be suitable for the particular purpose to which they address, they are not as suitable for allowing an individual snorkeling to dive beneath the water surface without water entering the breather tube. Conventional snorkel devices are not suitable nor designed for allowing an individual to dive beneath the water surface.

In these respects, the snorkel system according to the present invention substantially departs from the conventional concepts and designs of the prior art, and in so doing provides an apparatus primarily developed for the purpose of allowing an individual snorkeling to dive beneath the water surface without water entering the breather tube.

SUMMARY OF THE INVENTION

In view of the foregoing disadvantages inherent in the known types of snorkel devices now present in the prior art, the present invention provides a new snorkel system construction wherein the same can be utilized for allowing an individual snorkeling to dive beneath the water surface without water entering the breather tube.

The general purpose of the present invention, which will be described subsequently in greater detail, is to provide a new snorkel system that has many of the advantages of the snorkel devices mentioned heretofore and many novel features that result in a new snorkel system which is not anticipated, rendered obvious, suggested, or even implied by any of the prior art snorkel devices, either alone or in any combination thereof.

To attain this, the present invention generally comprises a breathing tube having an upper opening, a mouthpiece attached to a lower end of the breathing tube, a housing attached about an upper portion of the breathing tube, and a plurality of apertures within a lower portion of the housing. The upper opening of the breathing tube is positioned a finite distance above the highest of the apertures for creating a pressurized air pocket within the housing that prevents water level from rising above the upper opening thereby preventing water from entering the upper opening when the housing is fully submerged. The plurality of apertures within the lower portion allow the water to escape when the housing is elevated above the water surface and allow for air to immediately enter the housing and therefore the breathing tube thereby allowing the individual to freely breathe.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a snorkel system that will overcome the shortcomings of the prior art devices.

A second object is to provide a snorkel system for allowing an individual snorkeling to dive beneath the water surface without water entering the breather tube.

Another object is to provide a snorkel system that does not allow water to enter the breathing tube while an individual is submerged beneath a water surface.

A further object is to provide snorkel system that makes snorkeling easier for individuals of all experiences, ages and levels.

An additional object is to provide a snorkel system that does not require purging of water from within the breathing tube after being submerged.

A further object is to provide a snorkel system that has no moving components to block the water which may malfunction.

Another object is to provide a snorkel system that is comprised of a simple and cost effective design.

A further object is to provide a snorkel system that allows an individual to immediately begin breathing via the breathing tube after surfacing.

Another object is to provide a snorkel system that prevents water from entering the breathing tube regardless of the angle of the individual within the water.

A further object is to provide a snorkel system that prevents waves and splashed water from entering the breathing tube.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
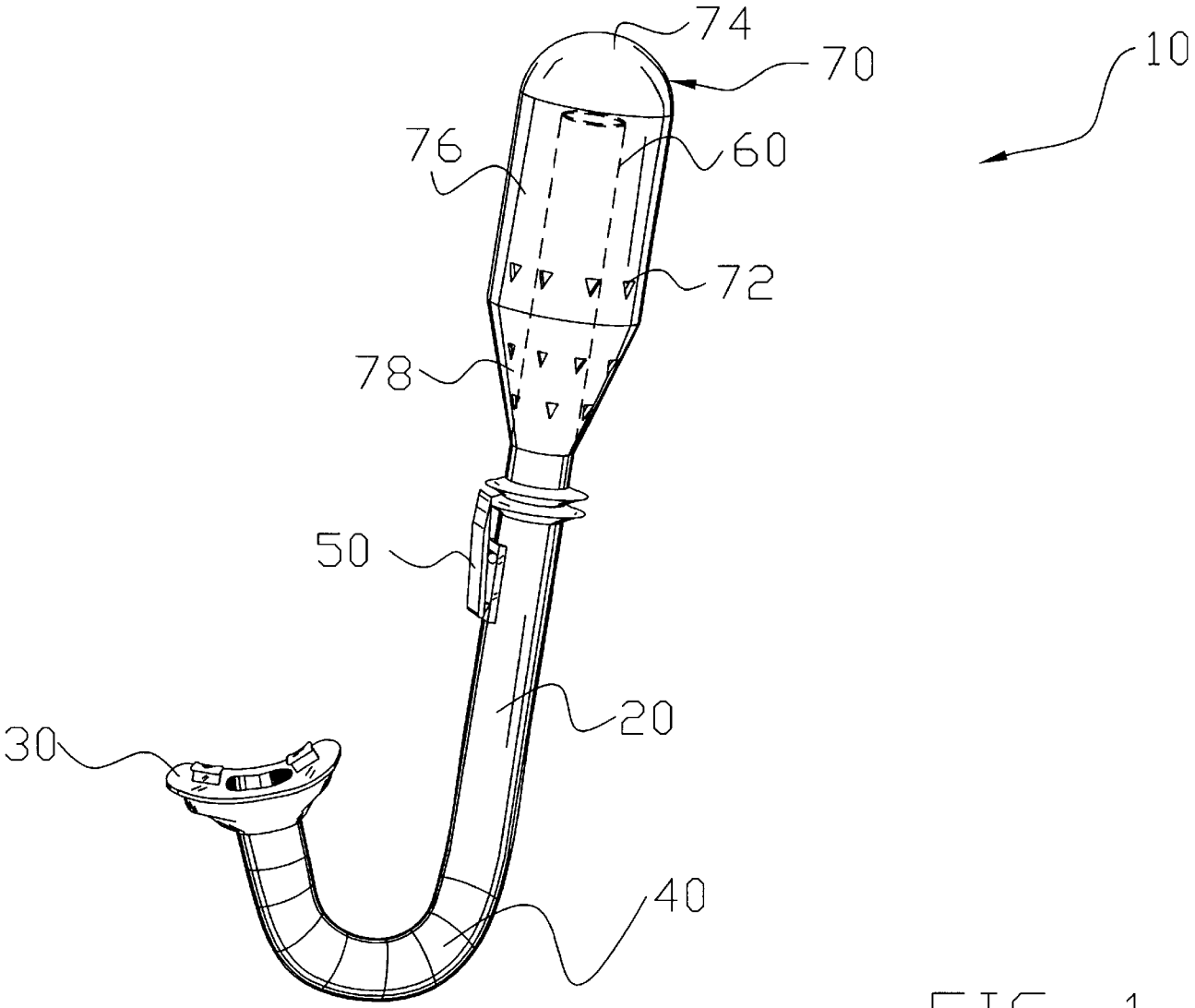
FIG. 1 is an upper perspective view of the present invention.
Figure 2:
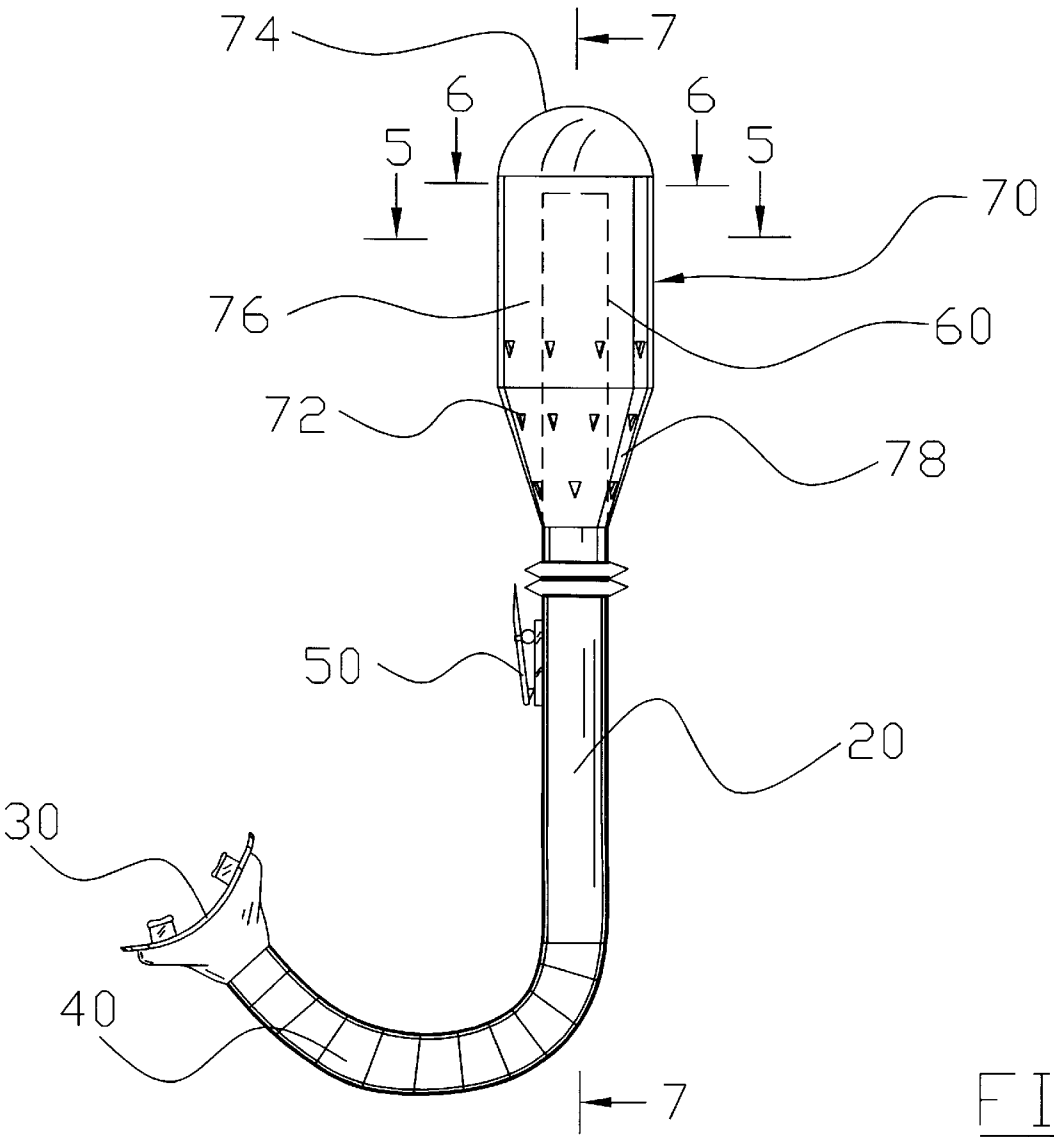
FIG. 2 is a side view of the present invention.

Turning now descriptively to the drawings, in which similar reference characters denote similar elements throughout the several views, FIGS. 1 through 9 illustrate a snorkel system 10, which comprises a breathing tube 20 having an upper opening 62, a mouthpiece 30 attached to a lower end of the breathing tube 20, a housing 70 attached about an upper portion 60 of the breathing tube 20, and a plurality of apertures 72 within a lower portion 78 of the housing 70. The upper opening 62 of the breathing tube 20 is positioned a finite distance above the highest of the apertures 72 for creating a pressurized air pocket within the housing 70 that prevents water level 14 from rising above the upper opening 62 thereby preventing water from entering the upper opening 62 when the housing 70 is fully submerged. The plurality of apertures 72 within the lower portion 78 allow the water to escape when the housing 70 is elevated above the water surface 12 and allow for air to immediately enter the housing 70 and therefore the breathing tube 20 thereby allowing the individual to freely breathe.

As shown in FIGS. 1 through 4 of the drawings, the breathing tube 20 is comprised of a structure similar to a conventional breathing tube 20 having an upper portion 60 with an upper opening 62 and a mouthpiece 30 attached to a lower opening thereof. The breathing tube 20 preferably has a flexible portion 40 for allowing adjustment of the breathing tube 20 during operation. A clip member 50 may also be attached to the middle portion of the breathing tube 20 for attaching to a mask strap or similar structure.

As shown in FIGS. 1 through 4 of the drawings, the housing 70 is attached about the upper portion 60 of the breathing tube 20. The housing 70 may have various shapes and sizes as can be appreciated. The housing 70 is comprised of a body 76 having a lower portion 78, a ceiling 74, and an interior chamber. The housing 70 is comprised of a solid impermeable material such as but not limited to plastic or metal. The ceiling 74 is preferably a domed structure as shown in FIGS. 1 through 4 of the drawings, however the ceiling 74 may be comprised of various other well known structures. The housing 70 may be comprised of an opaque, transparent or semi-transparent material such as but not limited to plastic.

As shown in FIGS. 1 through 4 and 7 through 9 of the drawings, a flexible joint is preferably positioned within the breathing tube 20 below the housing 70 and upper portion 60. The flexible joint allows the housing 70 and upper portion 60 to pivot about the flexible joint for allowing the housing 70 and upper portion 60 to be significantly aligned vertically within the water when submerged thereby preventing a portion of the water level 14 within the housing 70 from becoming higher than the upper opening 62.

The lower portion 78 of the housing 70 may be tapered inwardly toward the breathing tube 20. The lower portion 78 of the housing 70 preferably includes a plurality of apertures 72 within for allowing air to enter during normal snorkel operation as shown in FIGS. 1, 2, 5 and 6 of the drawings. The apertures 72 may be comprised of various shapes, sizes, designs and structures as can be appreciated. The apertures 72 may be comprised of a random pattern or horizontal rows as illustrated in FIGS. 1 through 4 of the drawings. The apertures 72 may surround the lower portion 78 of the housing 70 or the apertures 72 may be positioned in one or more specific locations upon the lower portion 78.

As shown in FIGS. 1 through 4 and 7 through 9 of the drawings, the upper apertures 72 are positioned a finite distance below the upper opening 62 of the breathing tube 20. The distance of the upper apertures 72 from the upper opening 62 ranges depending upon the volume of space above the upper apertures 72 and the design of the housing 70.

Figure 3:
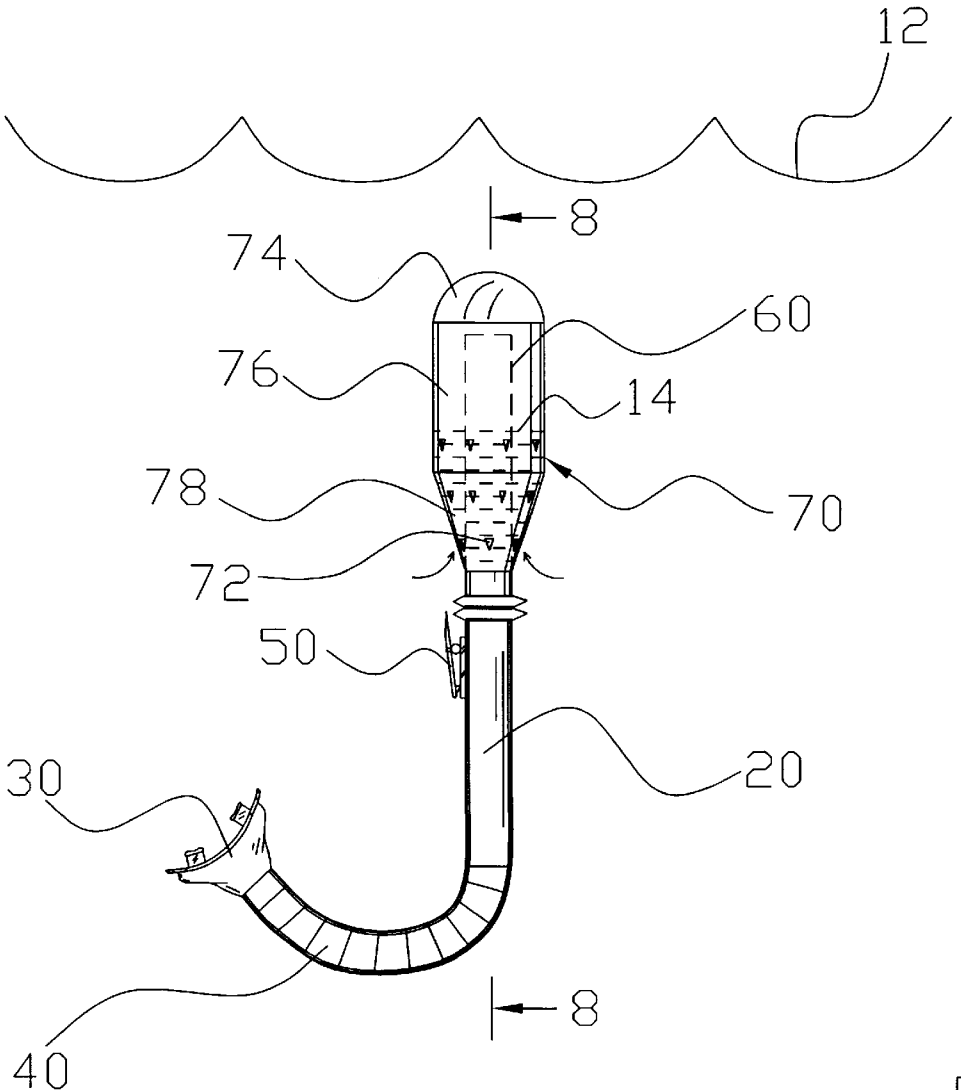
FIG. 3 is a side view of the present invention fully submerged beneath a water surface.
Figure 4:
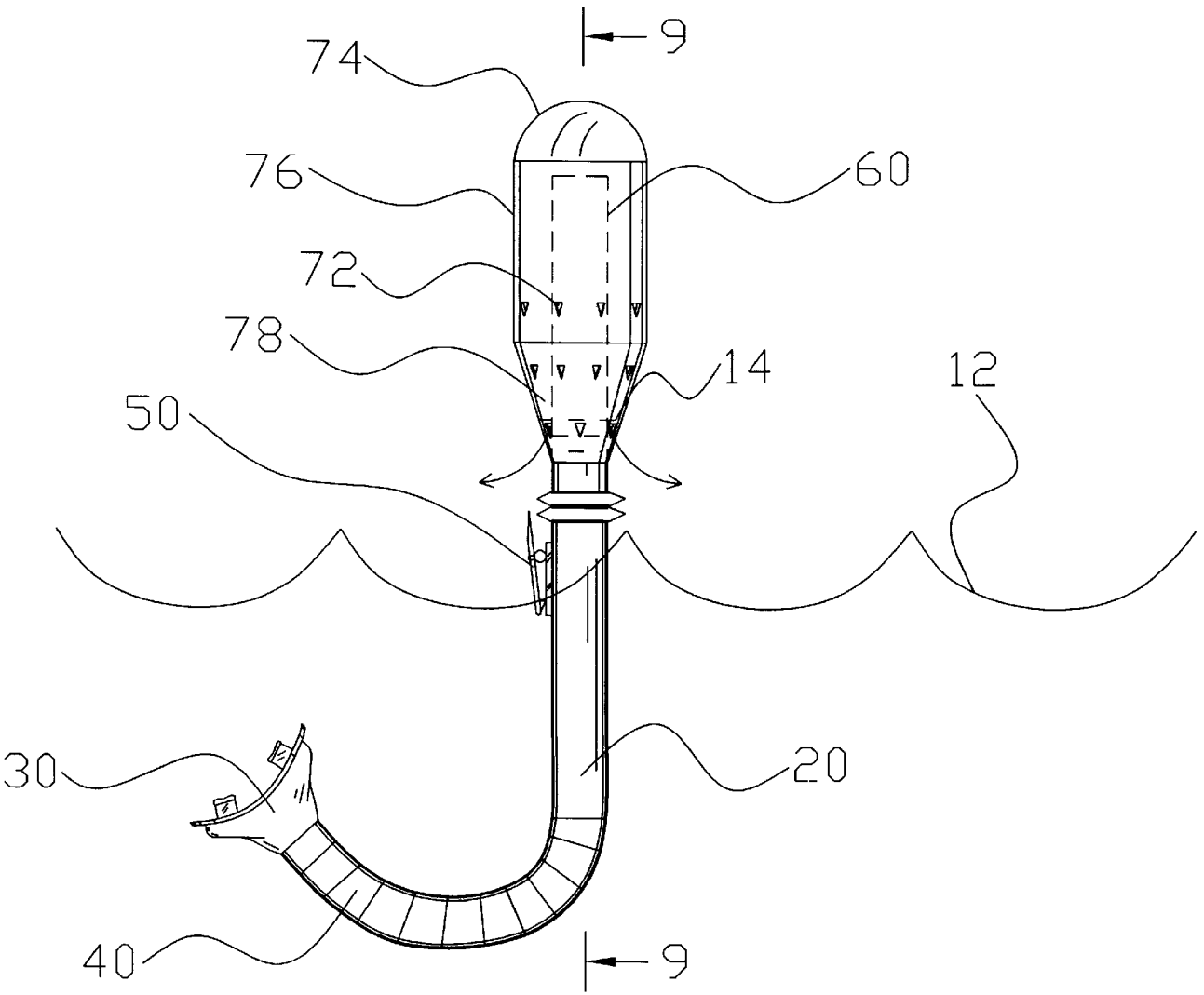
FIG. 4 is a side view of the present invention partially submerged between a water surface.
Figure 5:
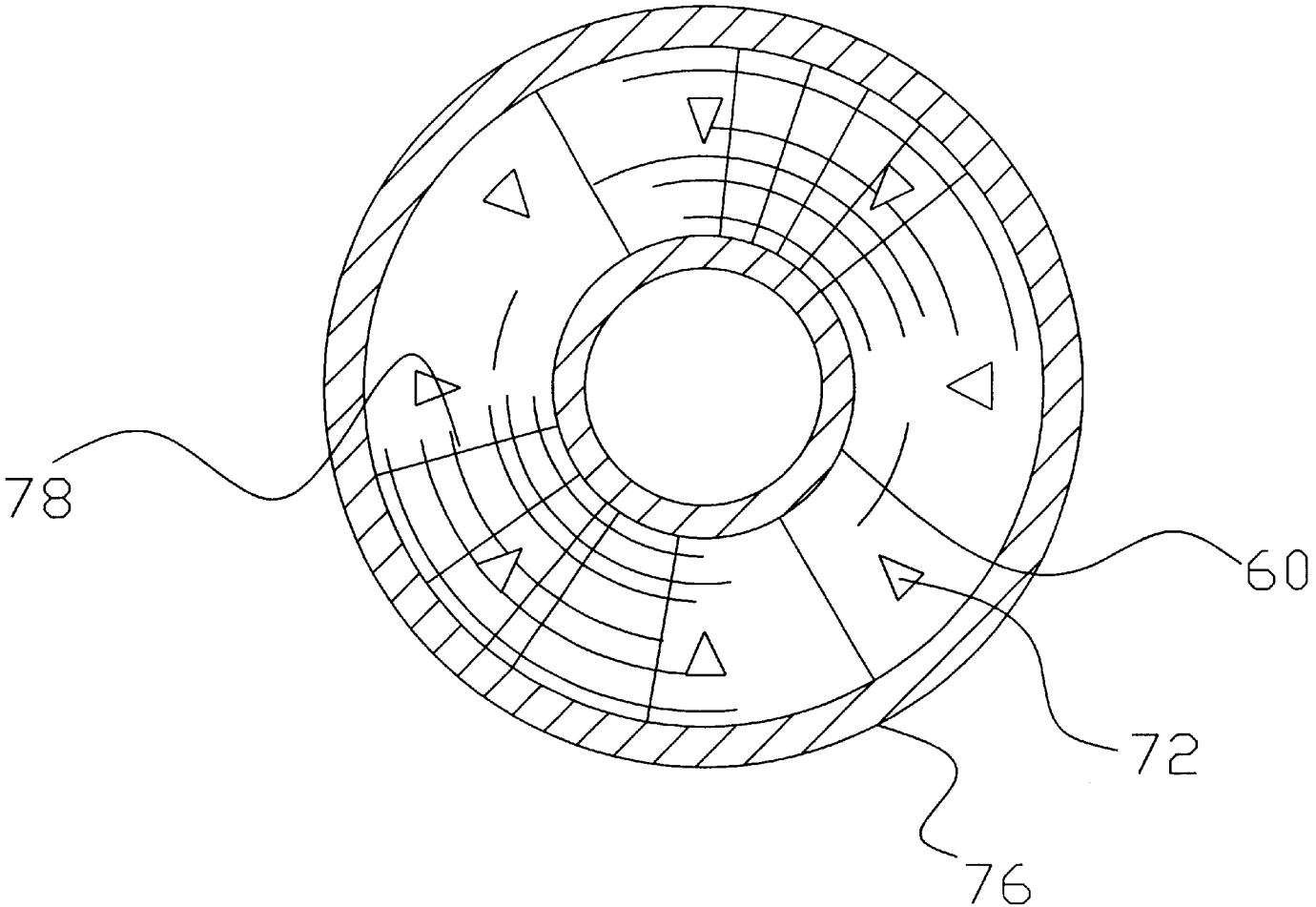
FIG. 5 is a cross sectional view taken along line 5—5 of FIG. 2.
Figure 6:
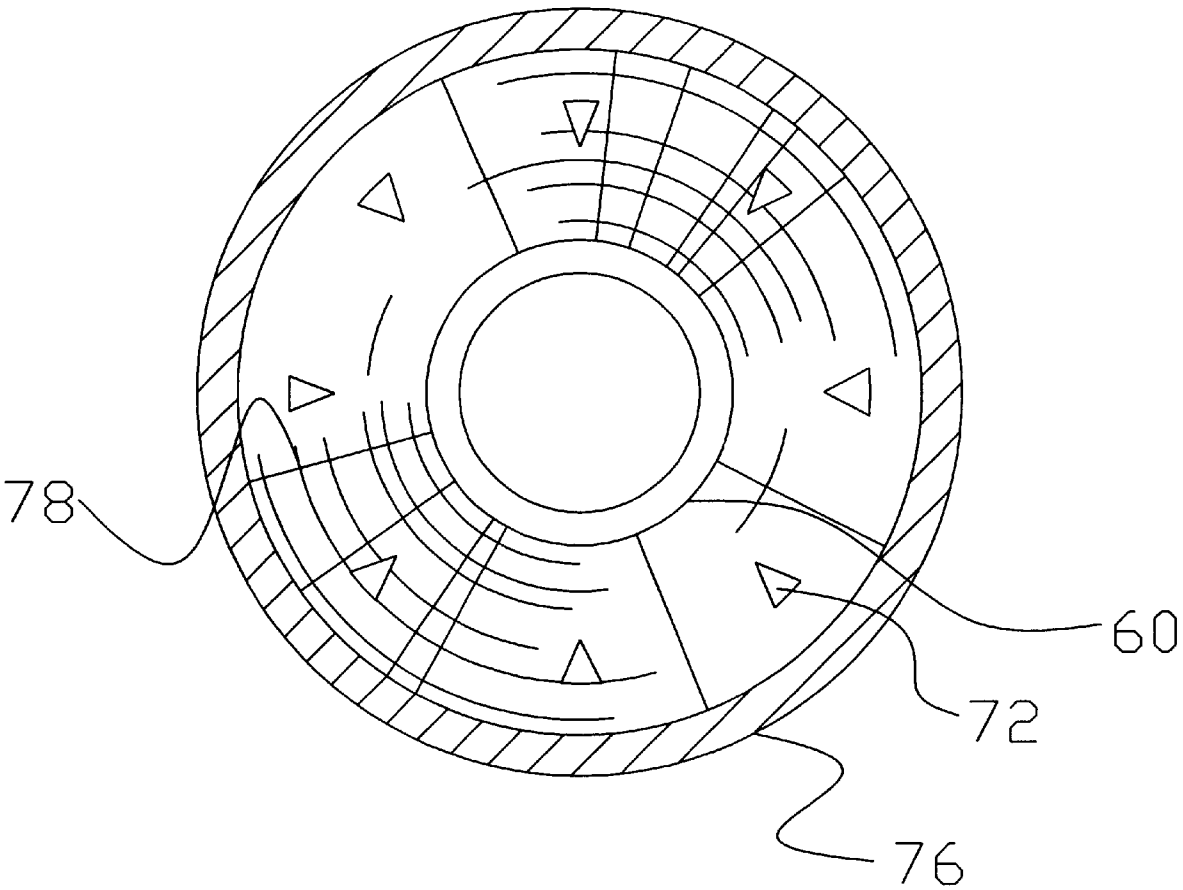
FIG. 6 is a cross sectional view taken along line 6—6 of FIG. 2.
Figure 7:
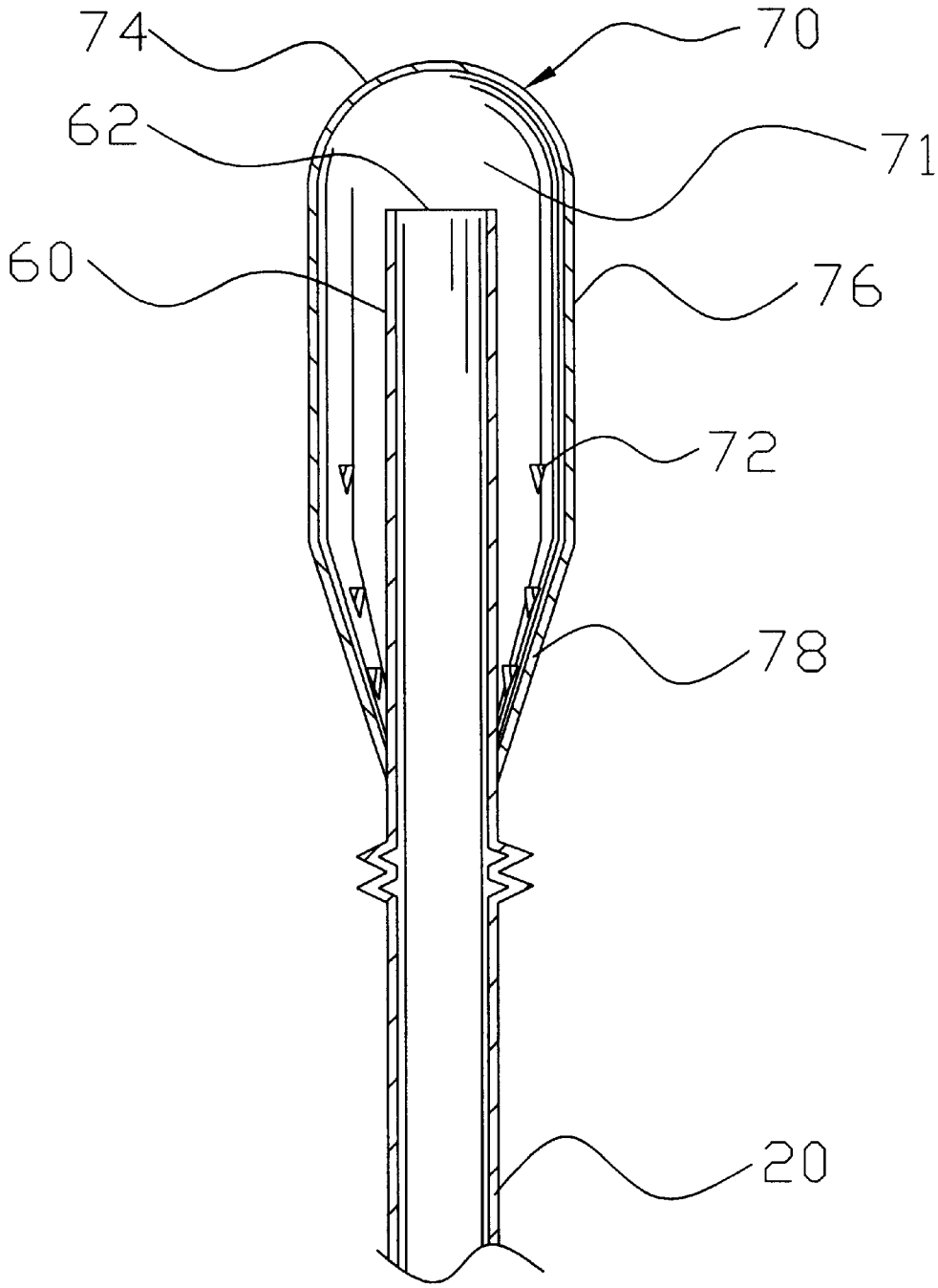
FIG. 7 is a cross sectional view taken along line 7—7 of FIG. 2.
Figure 8:
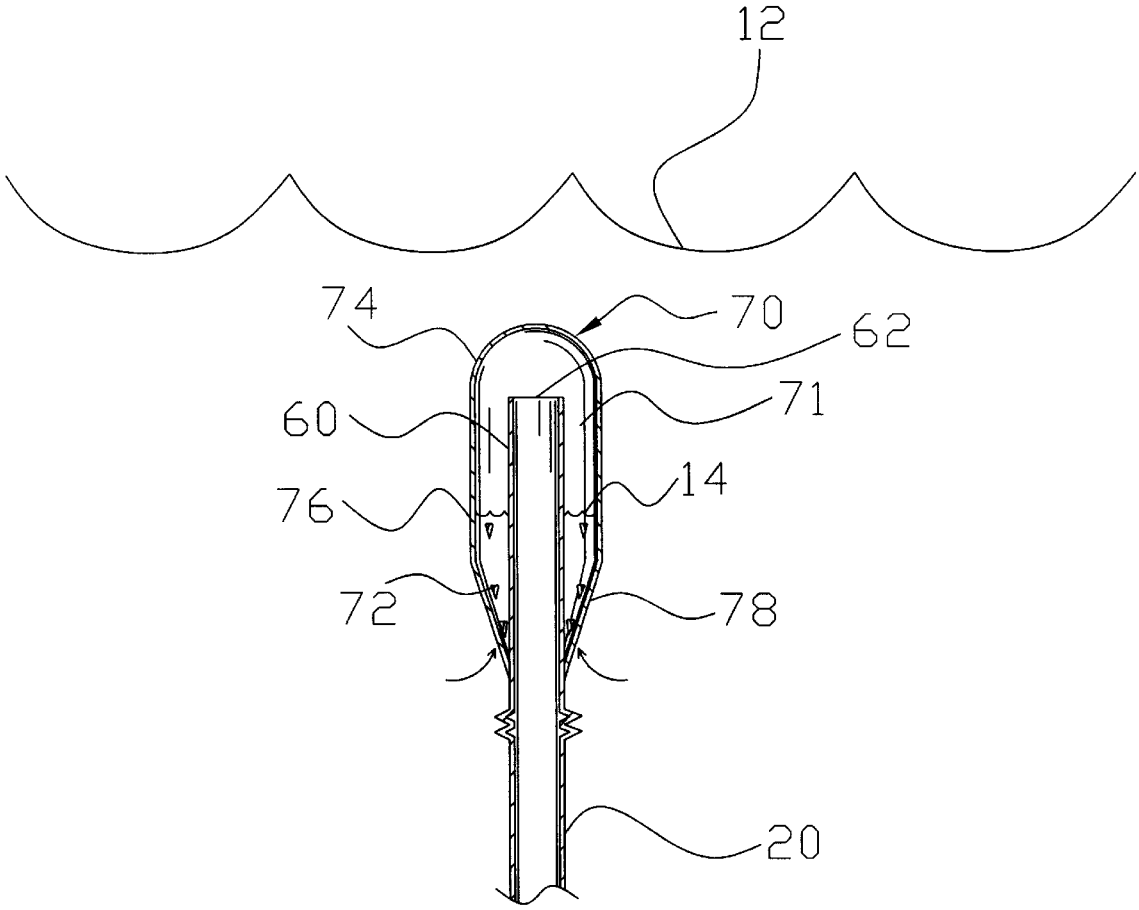
FIG. 8 is a cross sectional view taken along line 8—8 of FIG. 3.
Figure 9:
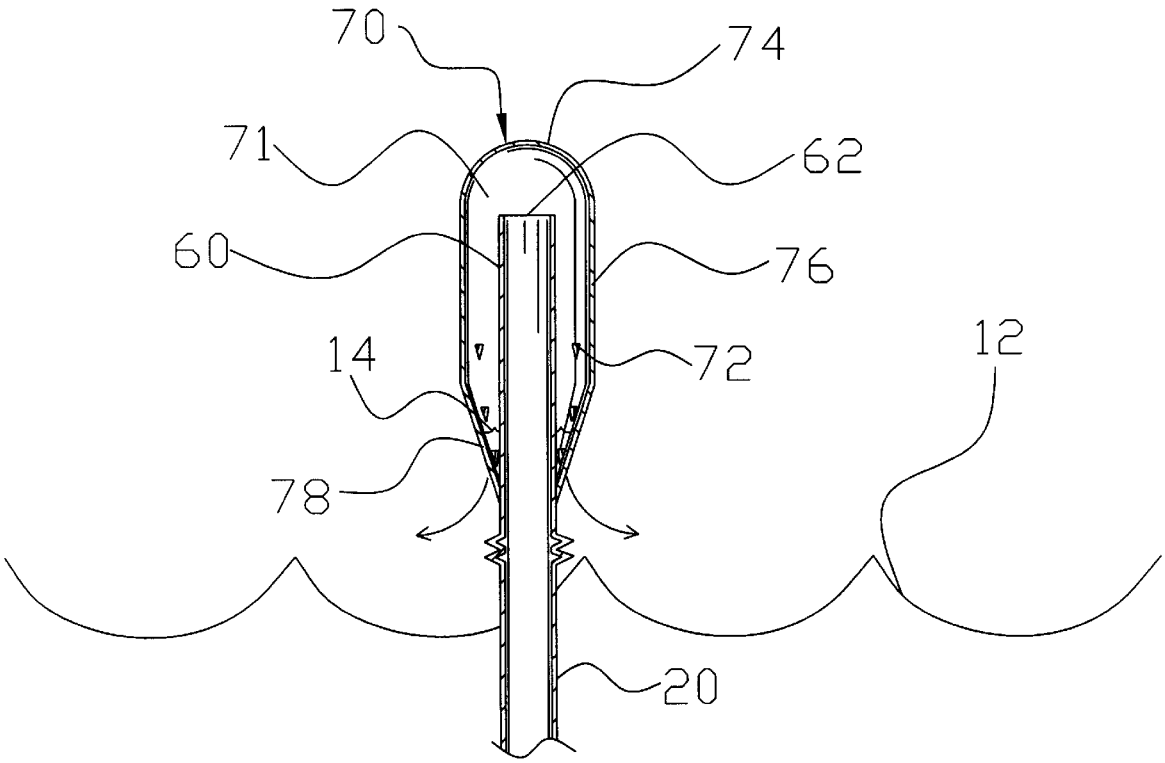
FIG. 9 is a cross sectional view taken along line 9—9 of FIG. 4.

In use, the user may operate the snorkel system 10 as a conventional snorkel device allowing them to freely breathe while their head is submerged with the housing 70 above the water surface 12 as shown in FIGS. 4 and 9 of the drawings. When the user dives deeper beneath the water surface 12, the housing 70 becomes partially or fully submerged as shown in FIGS. 3 and 8 of the drawings. Water is able to enter the interior of the housing 70 via the apertures 72 within the lower portion 78 of the housing 70. As the water enters the housing 70 the water level 14 within the interior of the housing 70 rises above the upper apertures 72 a finite distance until the air pressure within the upper cavity of the housing 70 (i.e. space between water level 14 and ceiling 74) equals the water pressure based upon the depth of the dive. If the user is positioned at an angle within the water, the flexible joint directly below the housing 70 allows the housing 70 to pivot into a substantially vertical position thereby maintaining the upper portion 60 of the breathing tube 20 substantially traverse to the water level 14 within the interior of the housing 70. When the individual surfaces from the depths below the water surface 12, the housing 70 becomes exposed above the water surface 12 as shown in FIGS. 4 and 9 of the drawings. The water within the interior of the housing 70 is allowed to escape through the apertures 72 for allowing free breathing by the individual through the breathing tube 20 as further shown in FIGS. 4 and 9 of the drawings. This process may be repeated numerous times by the individual as desired without water entering the breathing tube 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A snorkel system, comprising:

a breathing tube having a first opening, a first portion, and a second opening, wherein said first portion is substantially straight and has a longitudinal axis;

a housing having an interior chamber, a side wall and a ceiling, wherein said housing is attached about said first portion with said ceiling a first distance above said second opening, and wherein a main portion of said side wall extends substantially parallel to said longitudinal axis of said first portion of said breathing tube; and a plurality of apertures extending within said main portion of said side wall substantially traverse to said longitudinal axis, wherein said plurality of apertures are a second distance below said second opening, and wherein a pressurized air pocket is formed between said ceiling of said housing and said first portion of said breathing tube when said housing is submerged within a body of water.

2. The snorkel system of claim 1, including a flexible joint within said breathing tube between said first portion and said first opening, wherein said flexible joint allows said housing and said first portion of said breathing tube to automatically extend substantially vertical when positioned within water regardless of the position of a second portion of said breathing tube without requiring manual adjustment by a user.

3. The snorkel system of claim 1, wherein said plurality of apertures extend 360 degrees about said housing.

4. The snorkel system of claim 1, wherein said plurality of apertures are formed into a plurality of horizontal rows distally spaced in a vertical manner.

5. The snorkel system of claim 1, wherein said ceiling is dome shaped.

6. The snorkel system of claim 1, wherein said housing is a tubular structure.

7. The snorkel system of claim 1, wherein said housing has a height greater than a width.

8. The snorkel system of claim 1, wherein said second distance is at least one inch.

9. The snorkel system of claim 1, wherein said housing is tapered from said main portion to said breathing tube.

10. The snorkel system of claim 1, wherein said housing is concentric with said first portion of said breathing tube.

11. A snorkel system, comprising:

a breathing tube having a first opening, a first portion, and a second opening, wherein said first portion is substantially straight and has a longitudinal axis;

a housing having an interior chamber, a side wall and a ceiling, wherein said housing is attached about said first portion with said ceiling a first distance above said second opening, wherein a main portion of said side wall extends substantially parallel to said longitudinal axis of said first portion of said breathing tube, wherein said ceiling is dome shaped, wherein said housing is a tubular structure, wherein said housing has a height greater than a width, wherein said housing is tapered from said main portion to said breathing tube, and wherein said housing is concentric with said first portion of said breathing tube;

a plurality of apertures extending within said main portion of said side wall substantially traverse to said longitudinal axis, wherein said plurality of apertures are a second distance below said second opening, wherein said second distance is at least one inch, wherein said plurality of apertures extend 360 degrees about said housing, wherein said plurality of apertures are formed into a plurality of horizontal rows distally spaced in a vertical manner, and wherein a pressurized air pocket is formed between said ceiling of said housing and said first portion of said breathing tube when said housing is submerged within a body of water; and a flexible joint within said breathing tube between said first portion and said first opening, wherein said flexible joint allows said housing and said first portion of said breathing tube to automatically extend substantially vertical when positioned within water regardless of the position of a second portion of said breathing tube without requiring manual adjustment by a user.

* * * * *